US008132803B2

(12) United States Patent
Ogata et al.

(10) Patent No.: US 8,132,803 B2
(45) Date of Patent: Mar. 13, 2012

(54) SHEET PROCESSING APPARATUS AND IMAGE FORMING APPARATUS

(75) Inventors: Atsushi Ogata, Mishima (JP); Masayoshi Fukatsu, Sunto-gun (JP); Junichi Sekiyama, Numazu (JP); Hiroharu Tsuji, Namazu (JP); Akihiro Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 526 days.

(21) Appl. No.: 11/692,279

(22) Filed: Mar. 28, 2007

(65) Prior Publication Data

US 2007/0228634 A1 Oct. 4, 2007

(30) Foreign Application Priority Data

Mar. 31, 2006 (JP) ..... 2006-099057
Mar. 16, 2007 (JP) ..... 2007-068708

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.07, 270/58.08, 58.09, 58.11, 58.12, 58.17, 58.27
See application file for complete search history.

(56) References Cited

U.S. PATENT DOCUMENTS 5,938,192 A * 8/1999 Kosasa ..... 271/221
6,142,461 A * 11/2000 Asao et al. ..... 270/58.09
6,886,828 B2 * 5/2005 Saito ..... 271/225
6,997,456 B2 2/2006 Fukatsu et al.
7,281,708 B2 * 10/2007 Murata et al. ..... 270/58.12
7,300,046 B2 * 11/2007 Sugiyama et al. ..... 270/58.17
7,413,181 B2 * 8/2008 Iida et al. ..... 270/58.12
2003/0160376 A1 * 8/2003 Yamada et al. ..... 270/58.07
2004/0207148 A1 * 10/2004 Murata et al. ..... 271/207
2005/0230898 A1 * 10/2005 Suqiyama et al. ..... 270/58.08
2005/0278624 A1 12/2005 Nishikawa et al.
2006/0120784 A1 * 6/2006 Iida et al. ..... 399/407

FOREIGN PATENT DOCUMENTS

JP 64-75356 3/1989
JP 2-193860 7/1990
JP 10-109809 4/1998
JP 2004-059314 2/2004

* cited by examiner

*Primary Examiner* — Leslie A Nicholson, III
(74) *Attorney, Agent, or Firm* — Fitzpatrick, Cella, Harper & Scinto

(57) ABSTRACT

A sheet processing apparatus according to an aspect of the invention can process a first-size sheet having a first length and a second-size sheet having a second length smaller than the first length. The sheet processing apparatus includes an intermediate stacking portion on which the sheets are stacked; a stapler which performs a stapling process to the sheets; a second alignment reference wall and a first jogger which align the sheets with a stapling process position; and a second jogger which is moved toward the second alignment reference wall and first jogger. Irrespective of a sheet size, the second jogger is moved toward the second alignment reference wall and first jogger by an alignment distance necessary to align the second-size sheet with a stapling process position, which allows the stapler to staple the sheets with at least one of two staple legs.

10 Claims, 16 Drawing Sheets

SHEET PROCESSING APPARATUS AND IMAGE FORMING APPARATUS

BACKGROUND OF THE INVENTION

1. Field of the Invention

The present invention relates to a sheet processing apparatus which processes a sheet and an image forming apparatus provided with the sheet processing apparatus.

2. Description of the Related Art

Conventionally, in an image forming apparatus such as a copying machine, a printer, and a facsimile, there is disclosed a sheet processing apparatus wherein sheets to which images have been already formed are sequentially taken in the apparatus and a binding process is performed to the sheets (for example, see Japanese Patent Application Laid-Open No. 2004-59314).

For example, in a conventional sheet processing apparatus shown in FIG. 16, an intermediate roller discharges and stacks the sheet to and on an intermediate stacking portion. An alignment member presses the stacked plural sheets from an opposite side against an alignment reference wall fixed onto a stapler side, and thereby the sheets are aligned by causing the sheets to abut on the alignment reference wall. The stapler performs the binding process to the aligned sheets.

For the alignment in a sheet conveyance direction, the sheets are aligned by a mechanism such as a paddle and a roller which abuts on a sheet upper surface to move the sheet in an opposite direction to the conveyance direction.

In the case where the sheets having different lengths in a sheet width direction are aligned like the sheet processing apparatus of FIG. 16, a pressing amount (alignment amount) of the sheet by the alignment member is set according to a sheet size.

In the apparatus which can align an A4-size sheet and a letter-size sheet conveyed based on the center in the sheet width direction (center reference), when the sheet is longitudinally conveyed, the width of the letter size is about 216 mm, and the width of the A4 size is 210 mm. In the alignment amount of the alignment member, the A4 size is larger than the letter size by about 3 mm in a range of a sheet end portion to the alignment reference wall because the letter size is wider than the A4 size by about 6 mm.

When the sheet is transversely conveyed, the width of the letter size is about 279 mm and the width of the A4 size is 297 mm. Therefore, in the alignment amount of the alignment member, the letter size is larger than the A4 size by about 9 mm in the range of the sheet end portion to the alignment reference wall.

However, in the case where the sheet having the wrong size is conveyed due to a setting mistake at the sheet cassette, the alignment member aligns the sheets with a correct amount, and misalignment is possibly generated. A sheet regulating member for regulating an end of the sheet is provided in the sheet cassette, and a size of the sheet in the sheet cassette is distinguished by detecting a position of the sheet regulating member. The sheet regulating member is displaced by a user, even if the sheet having different size is set in the sheet cassette, the sheet regulating member may not be displaced. And in case the sheet regulating member is set in the wrong position, a size of the sheet in the sheet cassette is distinguished into different size.

Particularly, in the case where the letter-size sheet and the A4-size sheet are transversely conveyed, even if a sheet regulating member is set at the A4-size position in the sheet cassette, the letter-size sheet differs slightly from the A4-size sheet in a length of about 6 mm in the sheet conveyance direction. Therefore, the letter-size sheet can actually be accommodated. However, the letter-size sheet differs from the A4-size sheet by about 18 mm in the sheet width direction. Such the large difference in alignment amount has a large influence, as discussed below.

When the sheet is conveyed to the intermediate stacking portion, the alignment member stands by at the position having a predetermined distance away from one of the end portions of the sheet. In this case, it is assumed that the distance is 7 mm.

The stapler is placed outside a conveyance area so as not to obstruct the conveyance of the sheet, and the alignment reference wall is placed with respect to the stapler such that the sheet is aligned with a predetermined position. Therefore, the alignment reference wall is placed at the position separated away from the other end portion of the sheet by a predetermined distance. It is assumed that the distance from the end portion of the A4-size sheet is 20 mm. In the necessary alignment amount with which the alignment member causes the sheet to abut on the alignment reference wall, a distance is 7 mm from the standby position to the position where the alignment member abuts on one of the end portions of the sheet, and the a distance is 20 mm until the other end portion abuts on the alignment reference wall since the alignment member presses the sheet. Accordingly, the necessary alignment amount becomes 7+20=27 mm for the A4-size sheet, and the necessary alignment amount becomes 7+20+9 (difference in width direction between the A4-size sheet and the letter-size sheet)=36 mm for the letter size sheet.

In the case where the letter-size sheet is conveyed while wrongly detected as the A4-size sheet, when the sheet is conveyed to the intermediate stacking portion, the alignment member is located at the position which is 9 mm away from the original standby position where the alignment member is located in conveying the letter-size sheet. The distance of 9 mm corresponds to the difference in sheet width direction between the A4-size sheet and the letter-size sheet. Furthermore, because the alignment amount is decreased by about 9 mm, the sheet is moved only to the position which is about 18 mm away from the alignment reference wall.

The stapler cannot staple the sheets located at the position which is 18 mm away from the alignment reference wall, and the staple of the stapler strikes air. Accordingly, not only are the sheets not stapled, but also the staple which was intended for the sheets remains in the apparatus. When the phenomenon is frequently generated, misalignment, a jam, and breakage of the stapler are caused by the large amount of staples remaining in the apparatus.

SUMMARY OF THE INVENTION

In view of the foregoing, an object of the invention is to prevent the staple of the stapler from striking the air and to prevent the misalignment, the generation of the jam, and the breakage of the stapler without increasing the cost by adding a sensor, even if the sheet is conveyed while the sheet size is wrongly detected.

In order to solve the above problem, there are provided a sheet processing apparatus and an image forming apparatus provided therewith. A sheet processing apparatus according to an exemplary aspect of the invention which processes a sheet includes a stacking portion on which the sheet is stacked; a reference member on which end portions of the sheets stacked on the stacking portion are abutted to align the sheets; and an alignment member which is moved toward the reference member, wherein, in aligning either first-size sheet having a first length in a moving direction of the alignment member or a second-size sheet having a second length smaller than the first length, the alignment member is moved toward the reference member by an alignment distance necessary to align the second-size sheet.

According to the present invention, even if the sheet is conveyed while the sheet size is wrongly detected, the staple of the stapler can be prevented from striking the air, and the misalignment, the generation of the jam, and the breakage of the stapler can be prevented without increasing the cost by adding the mechanism for detecting the sheet alignment state to the sheet processing apparatus.

Further features of the present invention will become apparent from the following description of exemplary embodiments (with reference to the attached drawings).

DETAILED DESCRIPTION OF THE PREFERRED EMBODIMENTS

First Embodiment

A sheet processing apparatus and an image forming apparatus according to a first embodiment of the invention will be described below with reference to the drawings. The invention is not limited to sizes, materials, shapes and relative arrangements of components described in the first embodiment unless otherwise particularly stated.

(Image Forming Apparatus)

Figure 2:
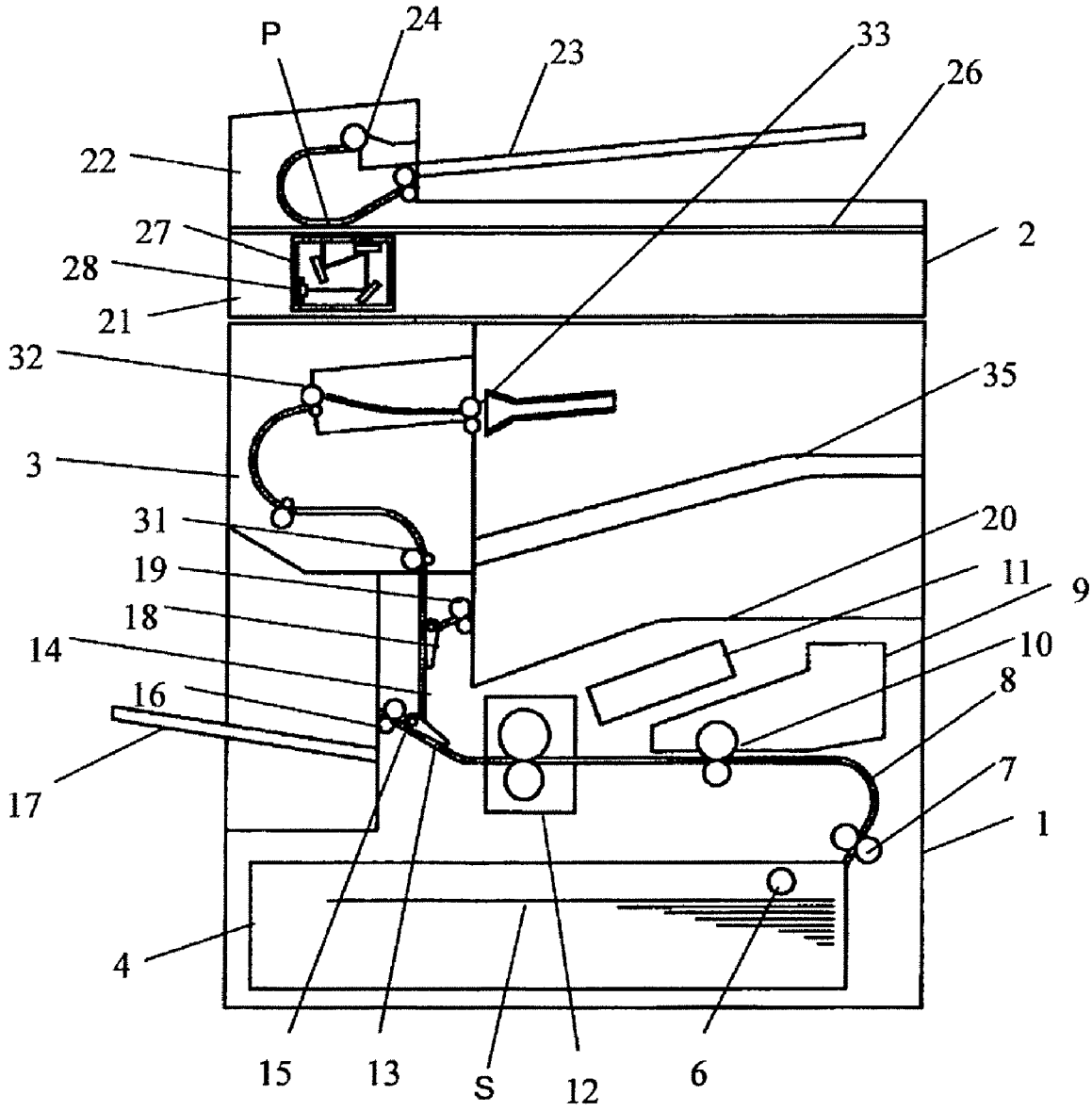
FIG. 2 is a sectional side view showing an image forming apparatus of the first embodiment.

FIG. 2 is a sectional side view showing the image forming apparatus of the first embodiment. As shown in FIG. 2, the image forming apparatus includes an image forming apparatus body 1, an image reading portion 2, and a sheet processing apparatus 3. The image forming apparatus body 1, the image reading portion 2, and the sheet processing apparatus 3 are respectively provided as an independent unit, the sheet processing apparatus 3 is sandwiched between the image forming apparatus body 1 and the image reading portion 2. The image forming apparatus body 1 forms the image on the sheet. The image reading portion 2 reads information described on the original. The sheet processing apparatus 3 performs a predetermined process such as stapling to the sheet in which the image is already formed by the image forming apparatus body 1.

(Image Forming Apparatus Body 1)

The image forming apparatus body 1 includes a sheet cassette 4, a feed roller 6, a separation conveyance roller 7, a conveyance guide 8, an image forming process unit 9, a laser scanner 11, and a fixing device 12. The image forming apparatus body 1 also includes conveyance switching flappers 13 and 18, conveyance paths 14 and 15, discharge rollers 16 and 19, and trays 17 and 20.

Plural sheets S stacked on the sheet cassette 4 are separated and fed one by one by the feed roller 6 and the separation conveyance roller 7. Then, the sheet S which has been separated and fed is conveyed to the image forming process unit 9 by the conveyance guide 8.

The image forming process unit 9 constitutes the image forming portion which forms a toner image on the sheet, and the image forming process unit 9 includes a photosensitive drum 10. The charged photosensitive drum 10 is irradiated with light from the laser scanner 11 to form an electrostatic image. The electrostatic image is developed with toner, and the toner image is transferred to the sheet S. The sheet S to which the toner image is transferred is conveyed to the fixing device 12, and the fixing device 12 applies heat and pressure to the sheet S to fix the toner image to the sheet S.

The sheet S to which the toner image is fixed is conveyed to either the face-down conveyance path 14 or the face-up conveyance path 15 by the first conveyance switching flapper 13. The face-down conveyance path 14 is of a sheet conveyance path through which the sheet is conveyed to an upper portion of the image forming apparatus body, and the face-up conveyance path 15 is of a sheet conveyance path through which the sheet is conveyed to a side portion of the image forming apparatus body.

The sheet guided to the face-up conveyance path 15 is discharged to and stacked on the face-up tray 17 by the face up discharge roller 16.

On the other hand, the sheet guided to the face-down conveyance path 14 is switched by the second conveyance switching flapper 18 and conveyed to either the upper-side sheet processing apparatus 3 or a path through which the sheet is discharged onto the side of the face-down tray 20 by the face-down discharge roller 19.

(Image Reading Portion 2)

The image reading portion 2 includes a scanner portion 21 and an automatic original feeding portion (hereinafter referred to as ADF) 22. In ADF 22, a feed roller 24 individually separates and feeds the plural originals stacked on the original stack tray 23, and the feed roller 24 causes the sheet to pass by an original read position P where an optical carriage 27 of a scanner portion 21 is stopped. ADF 22 can be opened and closed backward about a hinge (not shown) located in a rear portion of the apparatus, and ADF 22 is opened and closed when the original is placed on an original base plate glass 26.

The scanner portion 21 reads the information described on the original while the optical carriage 27 horizontally scans the original placed on the original base plate glass 26, and CCD 28 performs photoelectric conversion. In reading the original with ADF 22, as described above, the optical carriage 27 reads the information described on the original during the conveyance while stopped at the original read position P.

(Sheet Processing Apparatus 3)

Figure 3:
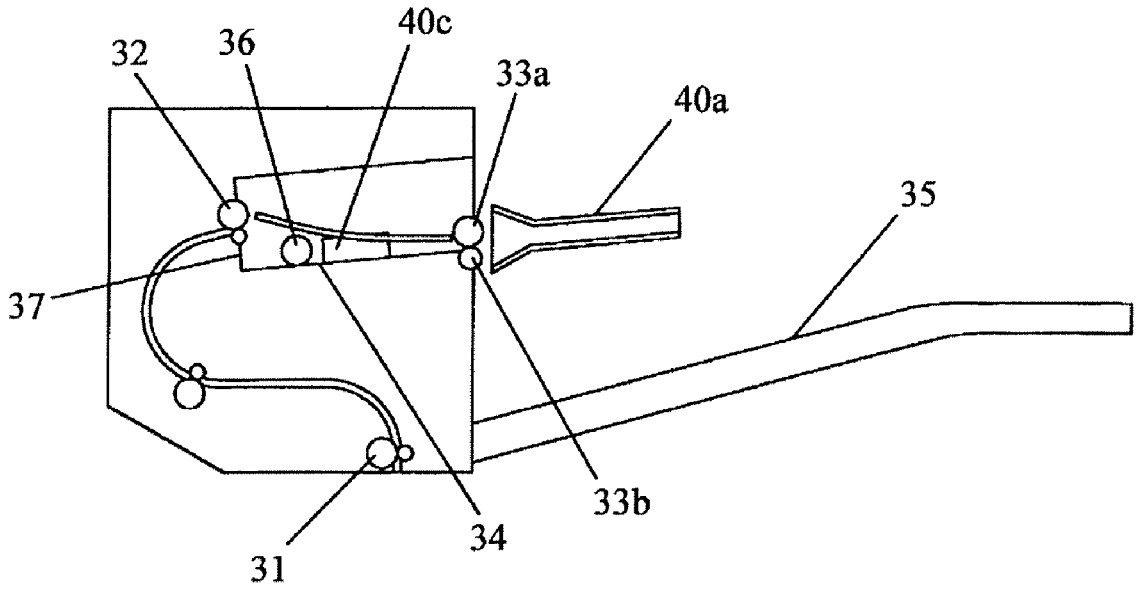
FIG. 3 is a sectional side view showing the sheet processing apparatus.

FIG. 3 is a sectional side view showing the sheet processing apparatus of the first embodiment. As shown in FIG. 3, the sheet processing apparatus 3 performs a stapling process to the sheet which is guided to the upper portion of the image forming apparatus body 1 by the second conveyance switching flapper 18. The sheet processing apparatus 3 includes an entrance roller 31, an intermediate conveyance roller 32, discharge rollers 33*a* and 33*b*, an intermediate stacking portion 34, a stack tray 35, an alignment roller 36, and a first alignment reference wall 37.

Figure 5:
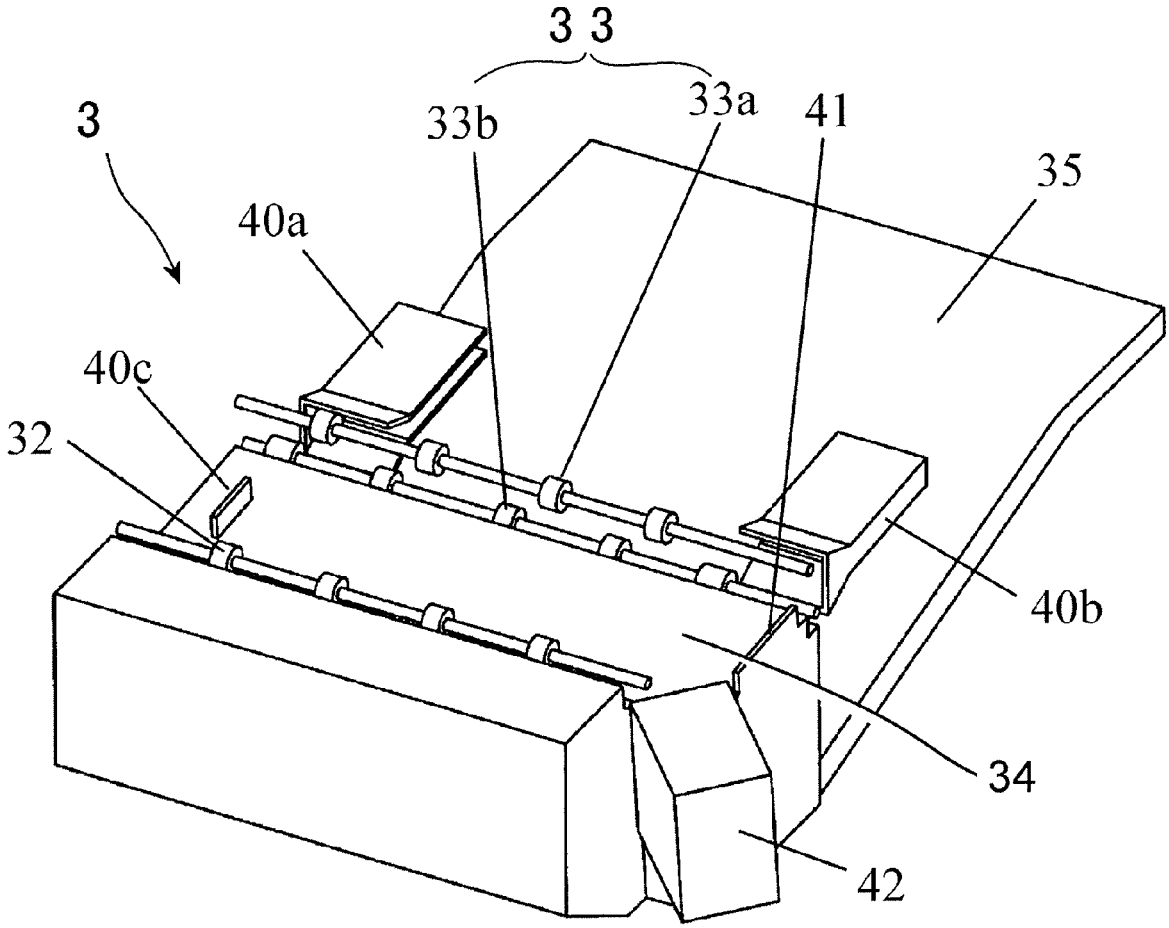
FIG. 5 is a perspective view showing the sheet processing apparatus.

As shown in FIG. 5, the sheet processing apparatus 3 can process the sheets having different sizes. The case where the sheet processing apparatus 3 aligns a first-size sheet having a first length and a second-size sheet having a second length smaller than the first length will be described in the first embodiment. In this embodiment, when the sheet regulating member is set in a position corresponding to the second-size sheet, the first-size sheet cannot be accommodated in the sheet cassette so that a size of the sheet in the sheet cassette is distinguished by detecting a position of the sheet regulating member. But, when the sheet regulating member is set in a position corresponding to the first-size sheet, the second-size sheet can be wrongly accommodated in the sheet cassette, and can feed from the sheet cassette.

In the sheet processing apparatus 3, irrespective of the sheet size of the sheet conveyed, alignment members (joggers 40*a* and 40*c*) are moved from a standby position toward reference member (second alignment reference wall 41 and jogger 40*b*) by an alignment distance necessary to align the second-length sheet with a stapling process position, which allows a stapler 42 to staple the sheets with at least one of two staple legs. The intermediate stacking portion 34 is a stacking portion on which the conveyed sheets are stacked based on the center in the width direction of the sheet.

Figure 4:
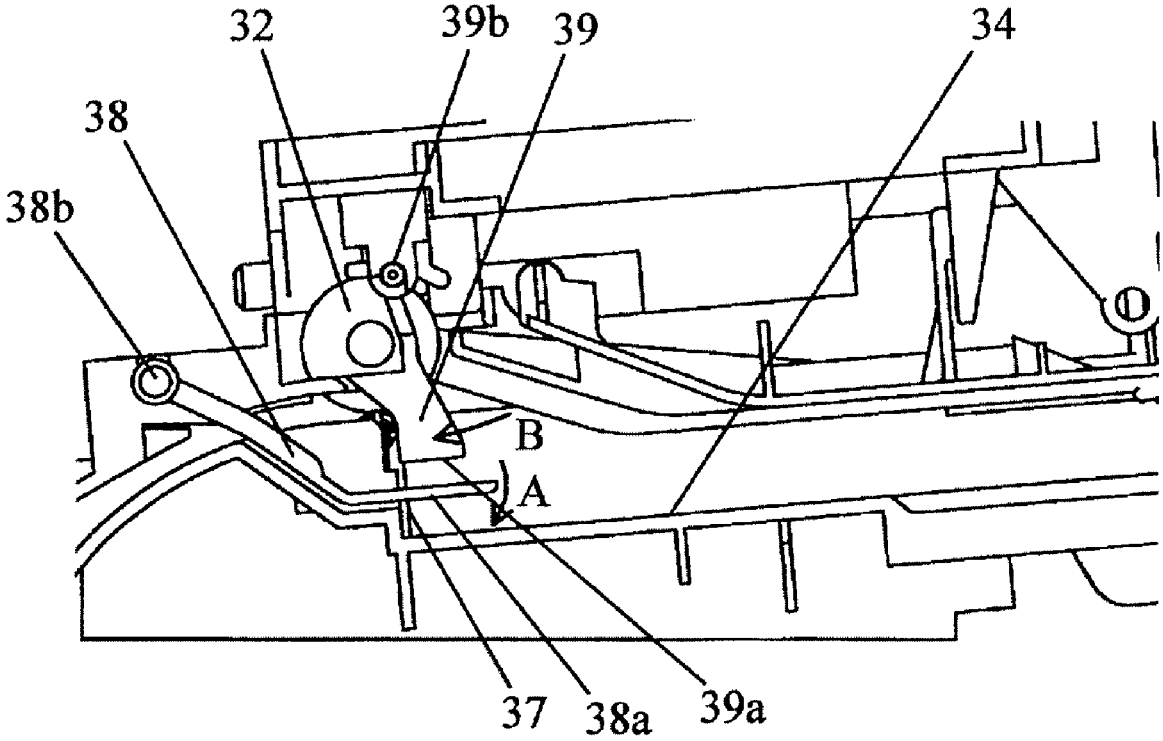
FIG. 4 is a sectional side view showing the sheet processing apparatus.

FIG. 4 is a view for explaining a configuration near the intermediate conveyance roller 3. As shown in FIG. 4, the sheet processing apparatus 3 includes a first pressing member 38 and a second pressing member 39.

The first pressing member 38 is retained while being rotatable about a fulcrum 38*b* located on an upstream side of a nip portion of the intermediate conveyance roller 32, and the first pressing member 38 is biased toward a direction of an arrow A by a biasing member such as a spring. The first pressing member 38 is pressed and rotated by the conveyed sheet, and the first pressing member 38 is retracted to a conveyance position during the conveyance of the sheet. When the sheet is not conveyed, the first pressing member 38 is located at a position where the first pressing member 38 is separated by a predetermined distance away from the stacking surface of the intermediate stacking portion 34, and a lower surface 38*a* intersects a first alignment reference wall 37 in the sheet conveyance direction.

The second pressing member 39 is retained while being rotatable about a fulcrum 39*b* located on a downstream side of the nip portion of the intermediate conveyance roller 32, and the second pressing member 39 is biased toward a direction of an arrow B by a biasing member such as a spring. The second pressing member 39 is also pressed and rotated by the conveyed sheet, and the second pressing member 39 is retracted to a conveyance position during the conveyance of the sheet. When the sheet is not conveyed, a lower surface 39*a* of the second pressing member 39 is located above the lower surface 38*a* of the first pressing member 38.

FIG. 5 is a view showing the intermediate stacking portion 34 which is of a stacking portion when viewed from above. As shown in FIG. 5, the sheet processing apparatus 3 includes joggers 40*a*, 40*b*, and 40*c*, a second alignment reference wall 41, and a stapler 42.

The second alignment reference wall 41 and the jogger 40*b* are reference members on which a sheet end portion in the width direction orthogonal to the conveyance direction of the sheet stacked on the intermediate stacking portion 34 is caused to abut to align the sheet with the stapling process position of the stapler 42.

The joggers 40*a* and 40*c* are an alignment member which moves the sheet in the direction orthogonal to the sheet conveyance direction toward the reference member (second alignment reference wall 41 and jogger 40*b*) from the standby position set according to the size of the conveyed sheet such that the sheet is not prevented from being conveyed to the intermediate stacking portion 34. While the plural sheets to which the stapling process is performed are conveyed to the intermediate stacking portion 34, the alignment members (joggers 40*a* and 40*c*) are moved at least one time by the alignment distance necessary to align the second-size sheet having the smaller width.

The stapler 42 is a processing unit which performs the stapling process of stapling the plural sheets stacked on the intermediate stacking portion 34 with the staple having the two staple legs. The plural sheets are conveyed to the intermediate stacking portion 34 based on the center in the width direction of the sheet (center reference).

Irrespective of the size of the sheet during the process, the joggers 40*a* and 40*c* are moved by the alignment distance necessary to move the second-size sheet having the smaller width to the processing position of the stapler 42 with respect to at least one sheet of the plural sheets to be processed.

In the discharge roller 33, an upper roller 33*a* is supported by a lower roller 33*b* while it can be separated from the lower roller 33*b*. In aligning the sheet, the alignment can be performed by separating the roller 33*a*. After the stapling process, the sheet S is nipped between the rollers 33*a* and 33*b* and discharged to and stacked on the stack tray 35.

The joggers 40*a* and 40*b* are located on the downstream side of the discharge rollers 33*a* and 33*b*, and the joggers 40*a* and 40*b* are formed in a U-shape so as to be able to support the upper and lower surfaces of the sheet S. In order to discharge the sheet S to the stack tray 35 after the stapling process, the joggers 40*a* and 40*b* can be retracted to the positions where the lower surfaces of the joggers 40*a* and 40*b* are located outside the width of the sheet S. The jogger 40*c* is located on the upstream of the discharge rollers 33*a* and 33*b*, and the jogger 40*c* is pressed and moved by the jogger 40*a* to align the sheet S while being synchronous with the jogger 40*a*.

As shown in FIG. 3, the alignment roller 36 aligns the sheet S in the conveyance direction. The alignment roller 36 can vertically be moved with respect to the intermediate stacking portion 34. When the alignment roller 36 is lowered, the alignment roller 36 moves the sheet S while abutting on the surface of the sheet S on the intermediate stacking portion 34. When the alignment roller 36 is raised, the alignment roller 36 is retracted to the position where the alignment roller 36 does not obstruct the conveyance of the sheet S to the intermediate stacking portion 34.

Figure 6:
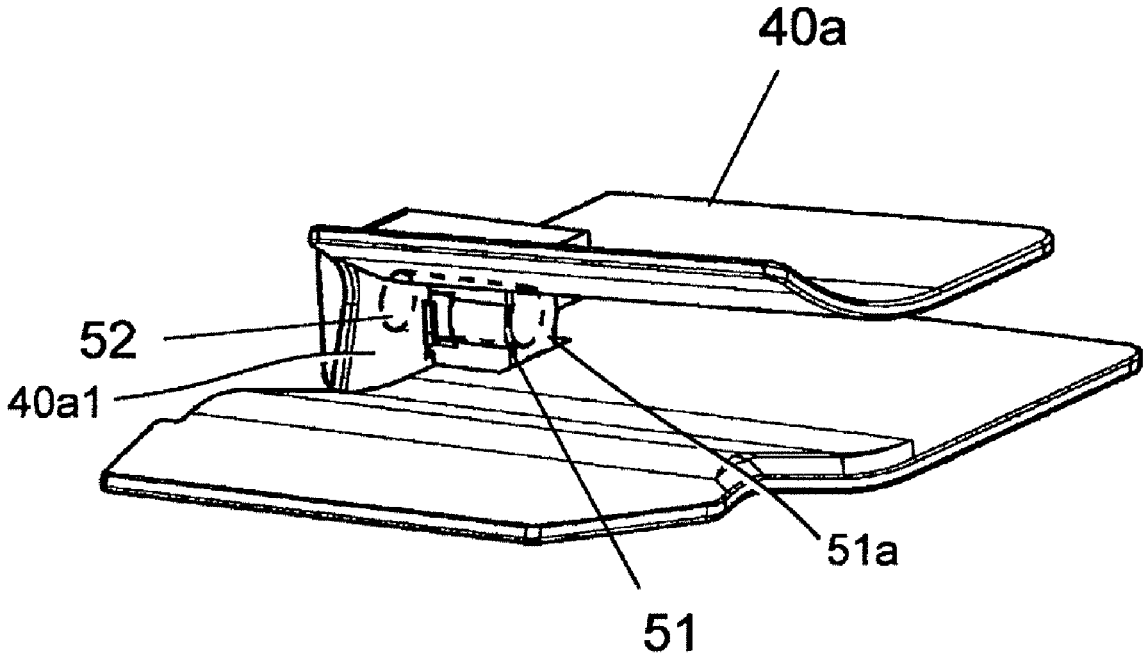
FIG. 6 is a perspective view of a sheet alignment member.

FIG. 6 is a perspective view of the sheet alignment member (jogger 40*a*). As shown in FIG. 6, a sheet abutting member 51 is attached to a sheet alignment surface 40*a*1 of the jogger 40*a*, and the sheet abutting member 51 is biased toward the alignment direction by a spring 52. The sheet abutting member 51 is an abutment member which elastically abuts on the end portion in the sheet width direction, and the sheet abutting member 51 can be retracted in the sheet alignment direction.

When the movement of the jogger 40*a* causes the sheet abutting surface 51*a* to abut on the sheet end portions to align the sheet S, even if the jogger 40*a* is further moved after the sheet S is aligned by abutting on the second alignment reference wall 41, the state in which the sheet abutting member 51 abuts on the sheet end portion is stopped by bending the spring 52. Therefore, the sheet abutting member 51 can be prevented from damaging the sheet S. The spring force of the spring biasing the sheet abutting member 51 is designed such that the spring 52 is not bent against resistance in aligning the sheet S until the sheet S is aligned by abutting on the second alignment reference wall 41. In the first embodiment, the sheet abutting member 51 is formed through the spring 52. Alternatively, for example, the sheet abutting member 51 may be formed by Mylar or plate spring to impart the elastic force to the sheet abutting member 51 in itself.

Figure 7:
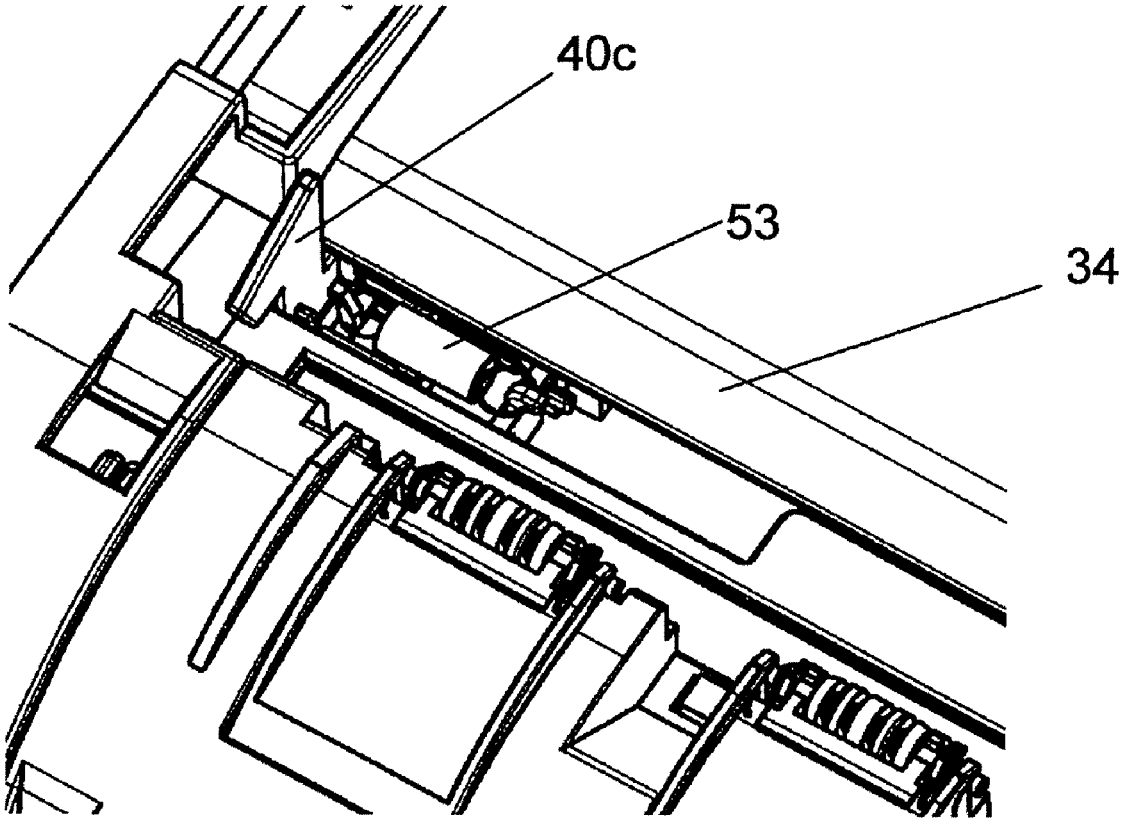
FIG. 7 is a perspective view of the sheet alignment member.

Similarly, as shown in FIG. 7, the jogger 40*c* is also biased by the spring 53, the jogger 40*c* is retracted after the sheet S abuts on the second alignment reference wall 41, which prevents the jogger 40*c* from damaging the sheet S.

(Sheet Processing Operation)

The sheet processing operation in the sheet processing apparatus 3 will be described below.

When the sheet S is conveyed to the sheet processing apparatus 3, the sheet S conveyed by the entrance roller 31 is discharged to the intermediate stacking portion 34 by the intermediate conveyance roller 32. Before the sheet S enters the intermediate stacking portion 34, the alignment surfaces of the joggers 40*a*, 40*b*, and 40*c* pressing the sheet S are moved to the position which is wider than the sheet conveyance area by a predetermined amount, and the lower surface of the sheet S is supported by the joggers 40*a* and 40*b*.

The discharge roller 33*a* is moved to a separation position to stop the rotation until the rear end of the sheet S goes through the intermediate conveyance roller 32 at the latest. Therefore, the sheet S going through the intermediate conveyance roller 32 is not discharged to the stack tray 35, but the sheet S is stacked on the intermediate stacking portion 34.

When the sheet S is stacked on the intermediate stacking portion 34, the end portion in the sheet width direction is aligned by the joggers 40*a*, 40*b*, and 40*c*. At this point, the jogger 40*b* which becomes the reference side is fixed to the position where the alignment surface is flush with the second alignment reference wall 41 in the direction orthogonal to the sheet conveyance direction. The jogger 40*a* and the jogger 40*c* operated in conjunction with the jogger 40*a* move the sheet S onto the side of the second alignment reference wall 41 to align the end portion in the sheet width direction.

Then, the alignment roller 36 is lowered to abut on the surface of the sheet S, which moves the sheet S onto the side of the first alignment reference wall 37 to perform the alignment in the sheet conveyance direction.

The same operation is repeatedly performed until the predetermined number of sheets to be stapled is reached, and the last sheet is aligned. Then, the joggers 40*a* and 40*c* are moved to the position where the sheet end face abuts on the second alignment reference wall 41, and the stapler 42 is driven to staple the sheets S while the sheets S are completely aligned.

Then, the joggers 40*a* and 40*b* are completely retracted to the position where the lower surfaces of the joggers 40*a* and 40*b* are wider than the width of the sheet S. At the same time, the sheet bundle is conveyed by the nip between the discharge rollers 33*a* and 33*b*, and the sheet bundle is discharged to and stacked on the stack tray 35.

(Method of Preventing Staple from Striking Air)

A method of preventing the staple of the stapler 42 from striking the air when the sheet is conveyed while the sheet size is wrongly detected will be described below. Although an instruction to convey the A4-size sheet as the first-size sheet is provided, actually the letter-size sheet is transversely conveyed as the second-size sheet while the longitudinal direction is set to the sheet width direction. Even in such cases, the sheet processing apparatus of the first embodiment can perform the stapling process. However, the invention is not limited to the first embodiment. The sheet processing apparatus of the invention can perform the stapling process even in the case of the sheets having different widths.

Figure 8:
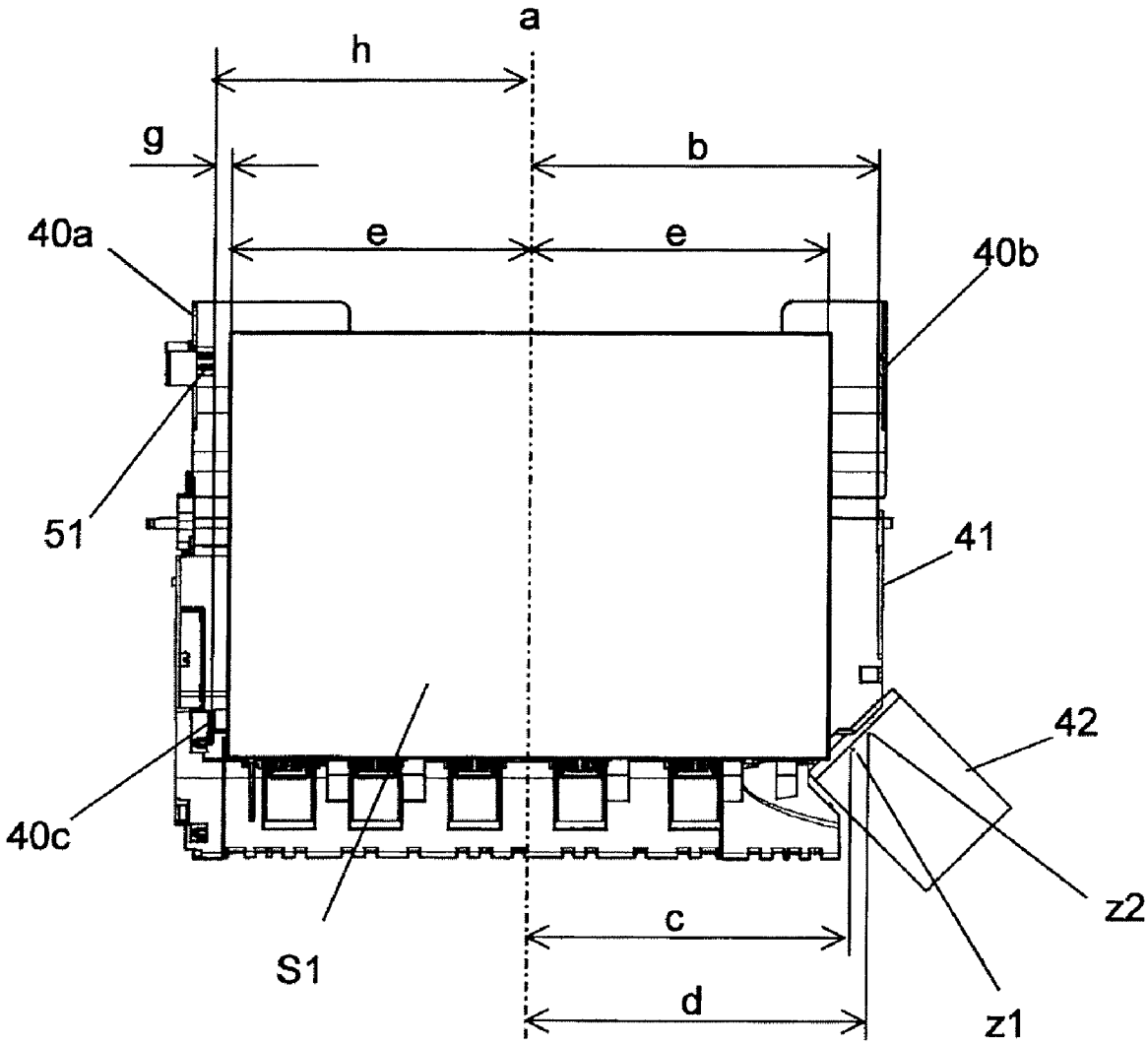
FIG. 8 is a top view of the sheet processing apparatus.
Figure 9:
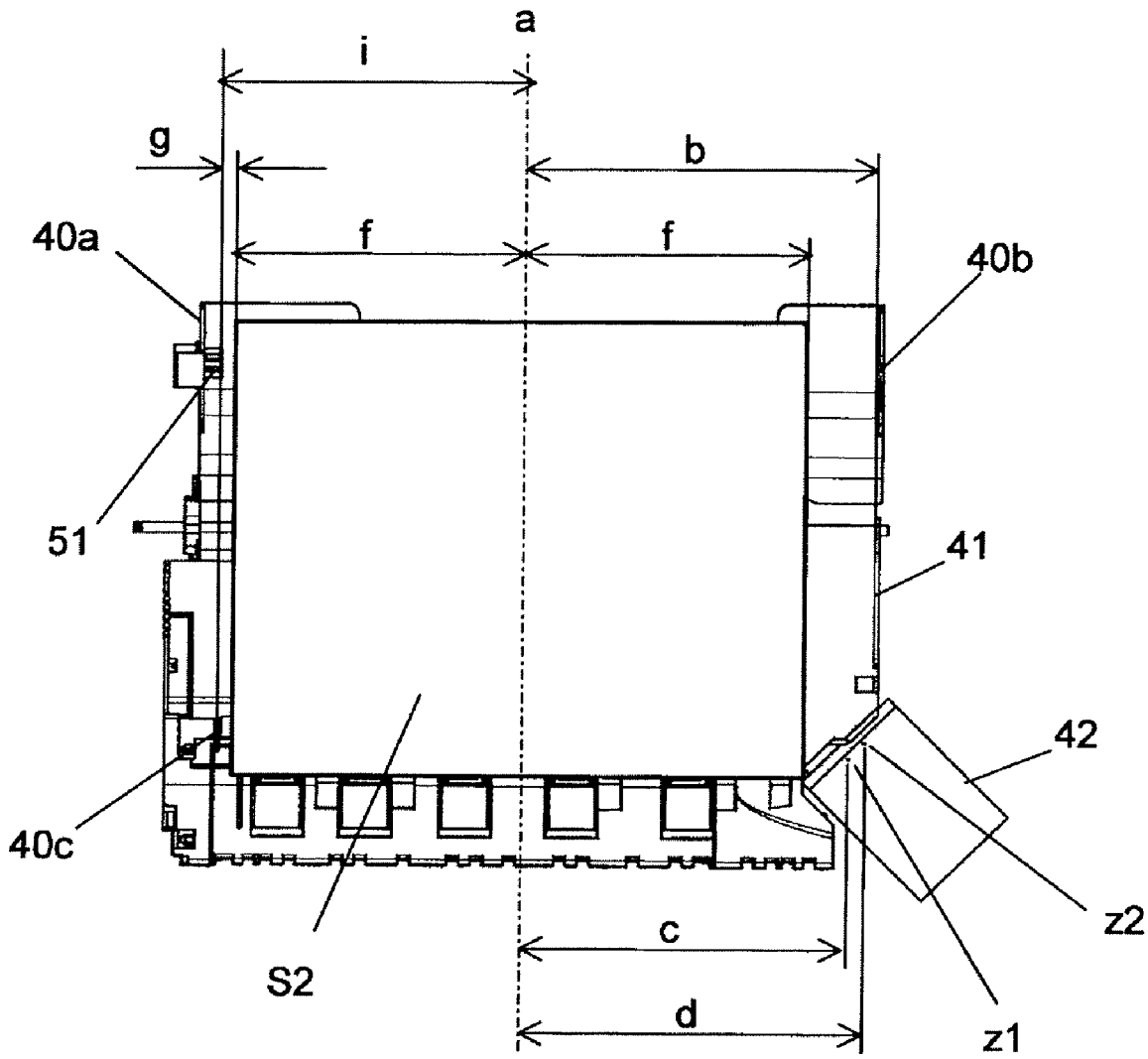
FIG. 9 is a top view of the sheet processing apparatus.

The width of the A4-size sheet is 297 mm (first length), and the width of the letter-size sheet is 279.4 mm (second length). It is assumed that a reference is the center in the width direction of the sheet conveyed to the intermediate stacking portion 34. In this case, end portions e of an A4 size sheet S1 on the sides of the joggers 40*a* and 40*c* are located at 148.5 mm away from the reference a as shown in FIG. 8. As shown in FIG. 9, end portions f of a letter-size sheet S2 on the sides of the joggers 40*a* and 40*c* are located at 139.7 mm away from the reference a.

The second alignment reference wall 41 which becomes the alignment reference in the sheet width direction is set at the position of b=173 mm way from the reference a. The stapler 42 is placed so as to be able to perform the stapling operation at an angle of 45° at the position of 4.5 mm away from the sheet end portion while the sheets S are aligned and abuts on the second alignment reference wall 41.

Positions z1 and z2 where the sheets S are stapled with the two staple legs are located at c=160.7 mm and d=168.5 mm away from the reference a. The position of the second alignment reference wall 41 is determined on condition that the conveyed sheet S does not collide with the stapler 42 even if the stapler 42 is placed at the position.

When the sheet abutting member 51 of the jogger 40*a* and the jogger 40*c* receive the conveyed sheet S, in the sheet abutting member 51 of the jogger 40*a* and the jogger 40*c*, the surfaces abutting on the sheet end portion are set at the position of g=7 mm away from the sheet end portion. This is a conveyance margin in the case where the sheet S is conveyed while shifted from the reference a. Accordingly, the jogger standby position becomes h=155.5 mm in the A4-size sheet, and the jogger standby position becomes i=146.7 mm in the letter-size sheet. The jogger standby position is changed according to each sheet size.

Assuming that the A4-size sheet is the first-size sheet and letter-size sheet is the second-size sheet, the position of h=155.5 mm becomes the first-size sheet standby position, and the position of i=146.7 mm becomes the second-size sheet standby position. The position of the end portion e (148.5 mm way from the reference a) and the position of the end portion f (139.7 mm way from the reference a) becomes the first-size sheet conveyance position and the second size sheet conveyance position respectively.

Figure 10:
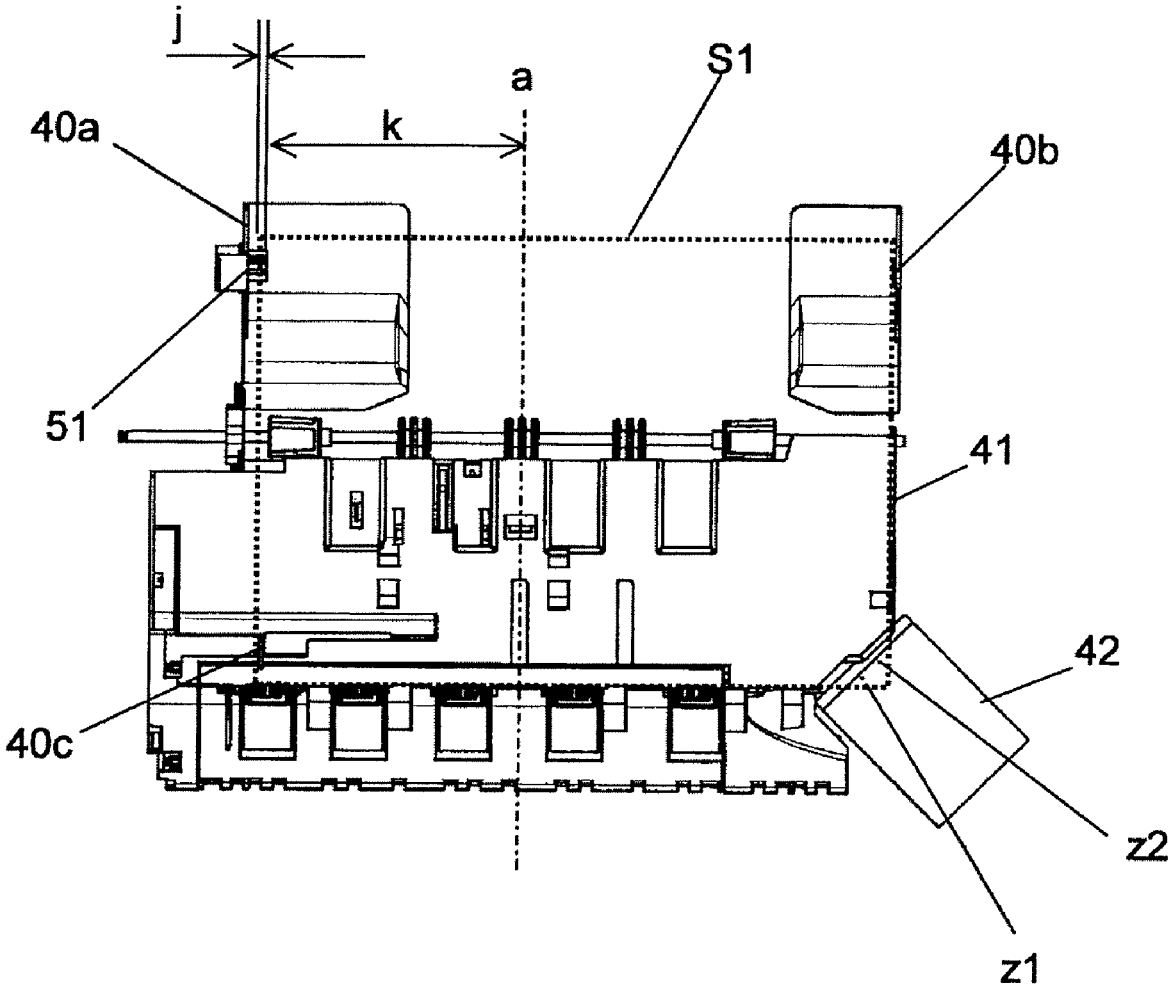
FIG. 10 is a top view of the sheet processing apparatus.
Figure 11:
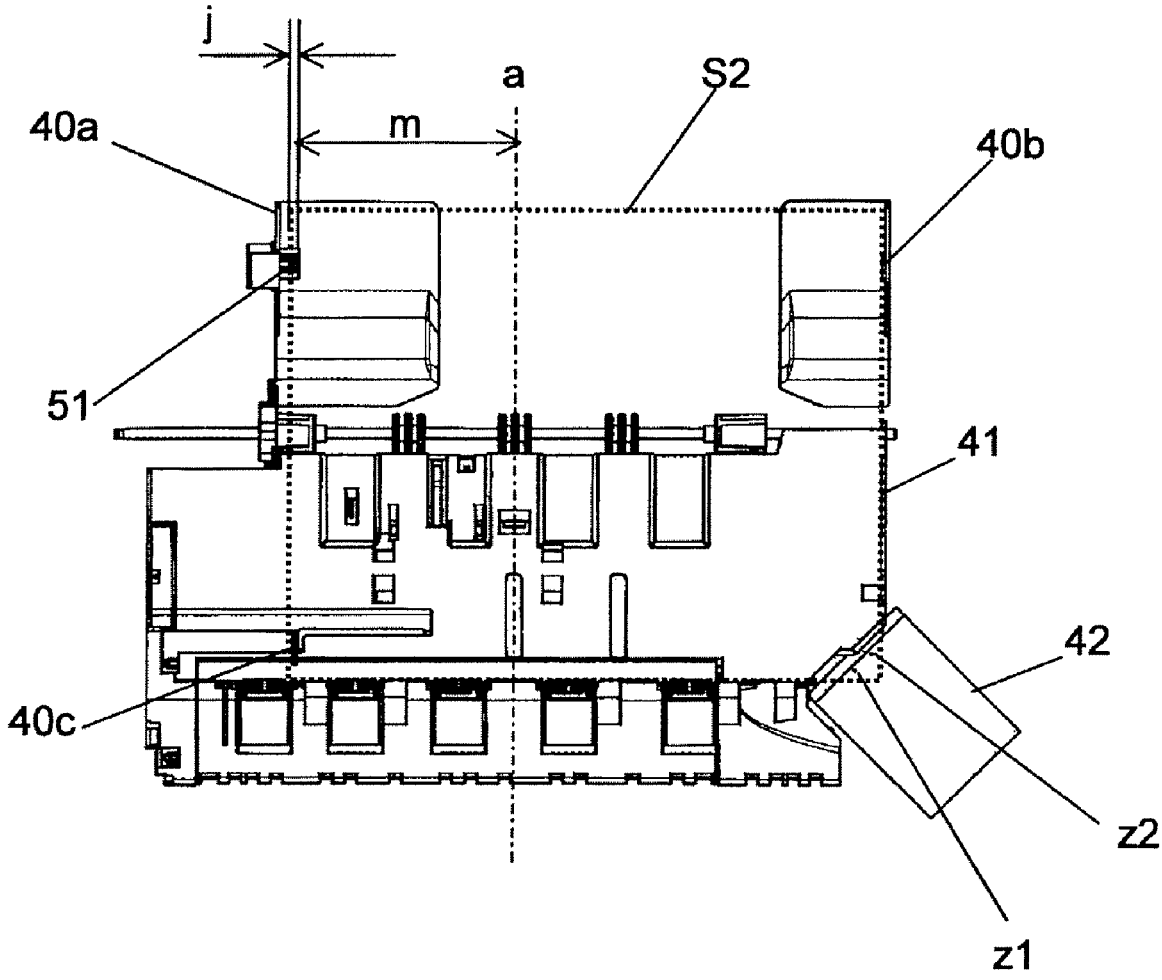
FIG. 11 is a top view of the sheet processing apparatus.

When the sheet is aligned in the width direction, usually the sheet is further pushed into the position which becomes narrower than the sheet width in consideration of a production error of a component or a fluctuation in sheet width. FIGS. 10 and 11 show the sheet processing apparatus in the case of the A4-size and letter-size sheets. In the first embodiment, as shown in FIGS. 10 and 11, after the sheet abuts on the second alignment reference wall 41, the jogger is further moved by j=3.5 mm as the additional alignment amount. Therefore, the sheet S is aligned by abutting securely on the second alignment reference wall 41. After the sheet S is aligned, the sheet abutting member 51 of the jogger 40*a* and the jogger 40*c* are retracted in the opposite direction to the alignment direction, which prevents the sheet abutting member 51 of the jogger 40*a* and the jogger 40*c* from damaging the sheet S.

Accordingly, the position where the sheet abutting member 51 of the jogger 40*a* and the jogger 40*c* are brought closest to the second alignment reference wall 41 in the alignment becomes k=120.5 mm away from the reference a for the A4-size sheet and m=102.9 mm away from the reference a for the letter-size sheet.

Thus, in the case where the conveyance margin is set, the position of k=120.5 mm away from the reference a becomes the first-size sheet alignment position, and the position of m=102.9 mm away from the reference a becomes the second-size sheet alignment position.

Figure 12:
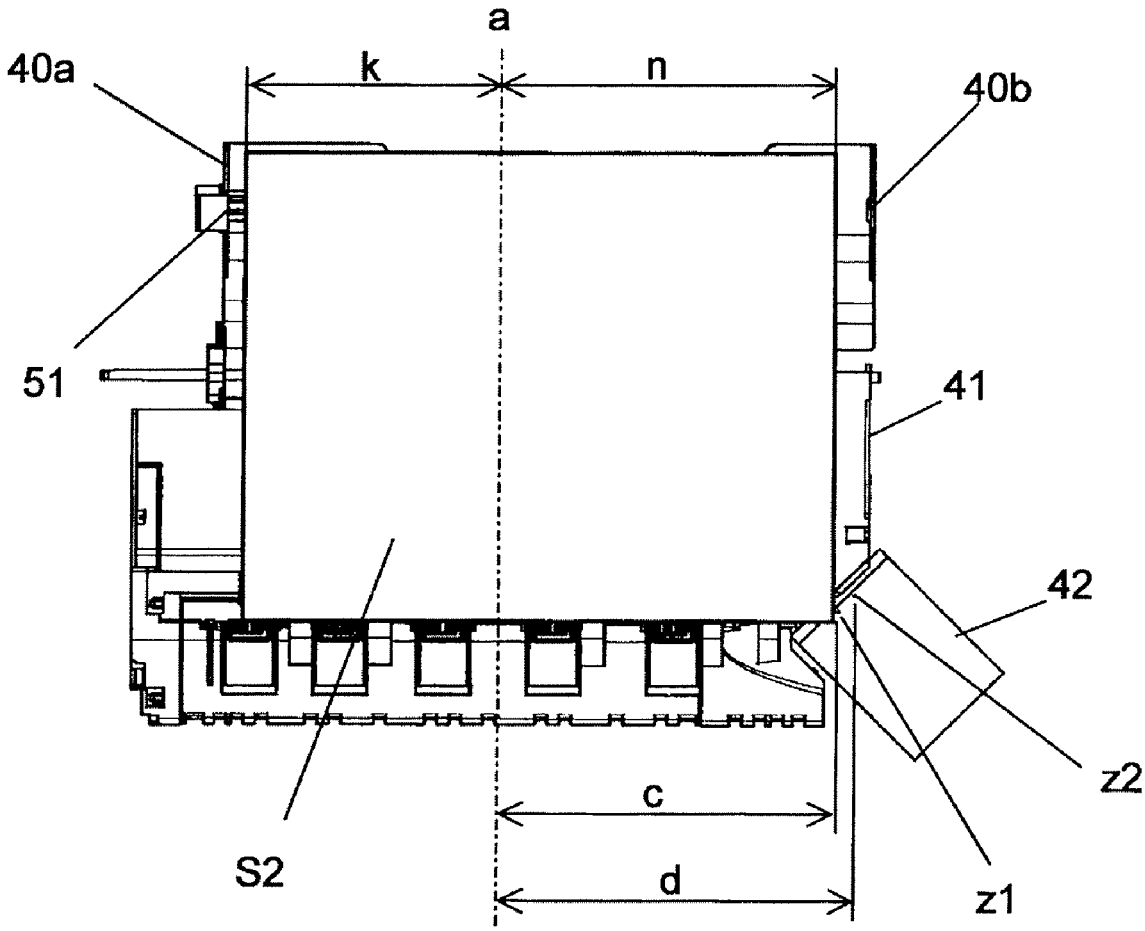
FIG. 12 is a top view of the sheet processing apparatus.

In the case where the process is performed when the letter-size sheet is conveyed while wrongly detected as the A4-size sheet, in the conventional sheet processing apparatus, the sheet abutting member 51 of the jogger 40*a* and the jogger 40*c* are moved only to the position of k=120.5 mm away from the reference a as shown in FIG. 12. At this point, there is the distance of 293.5 mm between the sheet abutting member 51 and jogger 40*c* and the second alignment reference wall 41.

However, because the letter-size sheet actually has the sheet width (second length) of 279.4 mm, the sheet S is moved only to the position of 14.1 mm away from the second alignment reference wall 41. At this point, the staple position z1 on the side of the reference a becomes c=160.7 mm away from the reference a while the sheet end portion on the side of the stapler 42 is located at the position of n=158.9 mm away from the reference a, so that the stapler 42 staples no sheet. Accordingly, the staple of the stapler 42 strikes the air and remains in the apparatus.

Therefore, in the first embodiment, even if the letter-size sheets are conveyed while wrongly detected as the A4-size sheet, all the sheet S conveyed as the A4-size sheet is moved to the position where the staples of the stapler 42 does not strike the air.

In the case where the sheet is conveyed while the sheet size is wrongly detected, in order to prevent at least the staple of the stapler 42 from remaining in the apparatus, the alignment operation is performed only to the first sheet in the plural sheets to be stapled. In the first embodiment, only one of the two legs of the staple strikes the first sheet, which allows the staple to be discharged to the outside the apparatus without striking the air.

Figure 1:
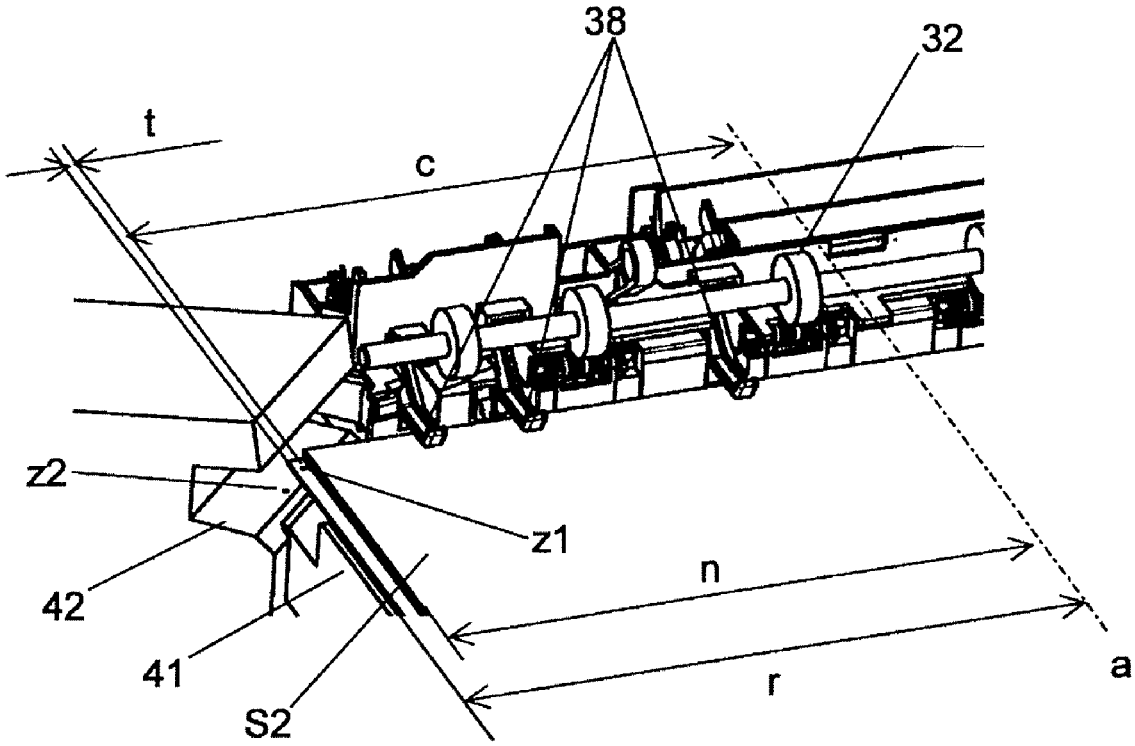
FIG. 1 is a perspective view showing a sheet processing apparatus according to a first embodiment of the invention.
Figure 13:
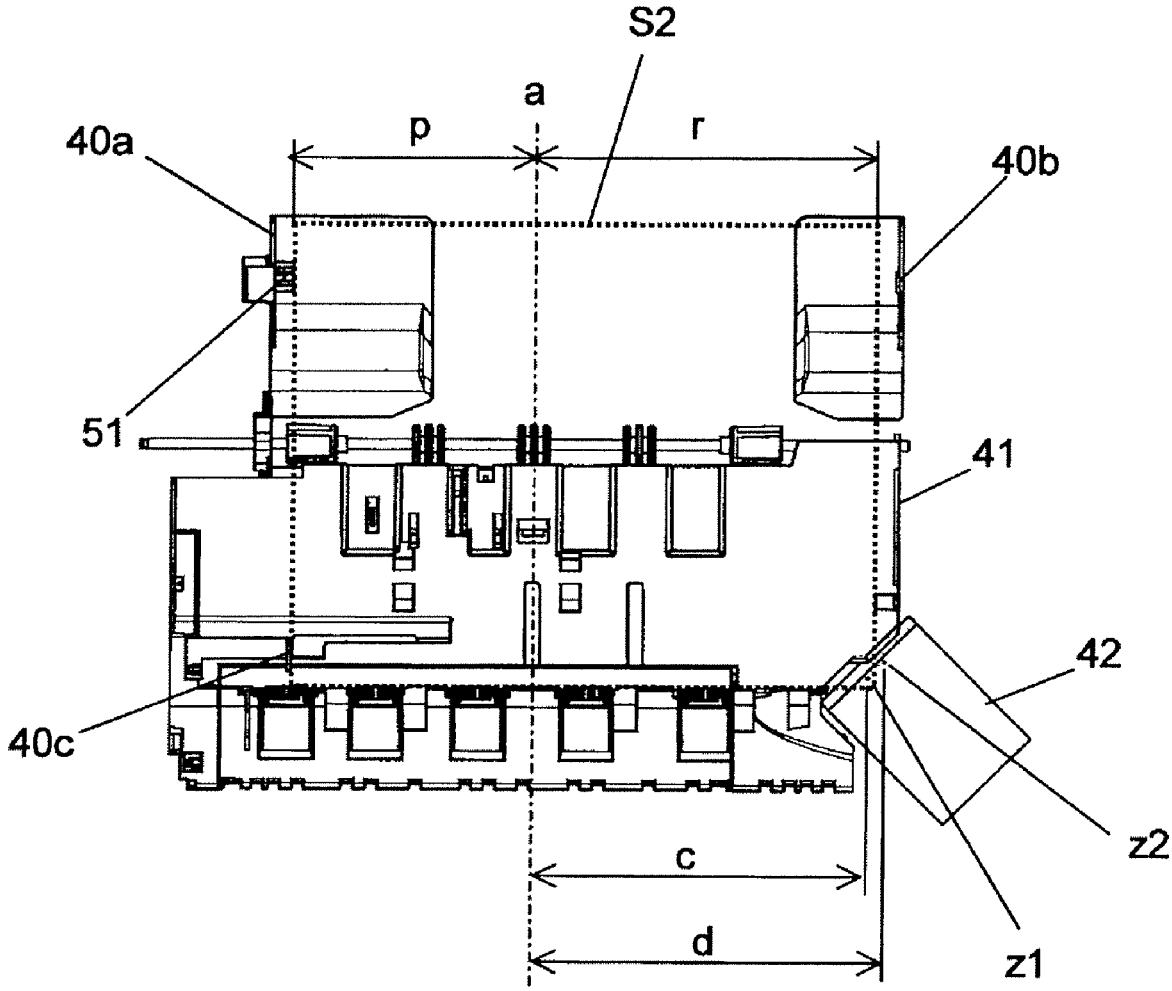
FIG. 13 is a top view of the sheet processing apparatus.

That is, as shown in FIG. 1, the sheet S is moved until the sheet end portion reaches the position of t=2 mm which is located outside the staple end portion z1 of c=160.7 mm on the side of the reference a of the stapler 42. Therefore, at least one of the two legs of the staple is hooked in the first sheet, and the staple is discharged to the outside of the apparatus. Since the relationship 160.7 mm (the staple position z1 on the side of the reference a of the stapler 42)+2 mm=158.9 mm (the position of the sheet end portion on the side of the stapler 42)=3.8 mm is satisfied, it is sufficient that only the first sheet is aligned while further pushed by at least 3.8 mm other than the sheets. However, in this case, the first sheet is aligned while further pushed by 4.5 mm in consideration of the fluctuation in sheet width. Accordingly, as shown in FIG. 13, the sheet end portions are located at the positions of p=16 mm and r=163.4 mm.

In this case, the first sheet is additionally aligned with respect to the second alignment reference wall 41 by the total of 8 mm in which 4.5 mm is added to the original additional alignment amount of 3.5 mm in the A4-size sheet width. Thus, irrespective of the sheet size, the sheet abutting member 51 and the jogger 40*c* are moved for the first sheet by the second-size sheet alignment distance in which the sheet abutting member 51 and the jogger 40*c* are moved when the alignment operation is originally performed to the sheet having the second length. In the case where the sheet is conveyed based on the center reference, the distance between the second alignment reference wall 41 and the sheet end portion on the side of the second alignment reference wall 41 becomes the maximum in the second-size sheet, the sheet abutting member 51 and the jogger 40*c* are moved by the second-size sheet alignment distance irrespective of the sheet size, which allows the staple to be prevented from striking the air. In the case where the second-size sheet is conveyed to the intermediate stacking portion 34 while the sheet size is not wrongly detected, obviously the sheet is aligned at the correct stapling process position by the movement of the second-size sheet alignment distance.

In the case where the A4-size sheet is conveyed to the intermediate stacking portion 34 while the sheet size is not wrongly detected, the sheet abutting member 51 and the jogger 40*c* is configured to be retractable by at least 8 mm against the spring, so that the sheet abutting member 51 and the jogger 40*c* don't damage the sheet even if the A4-size sheet is pushed by 8 mm. That is, the sheet abutting member 51 and the jogger 40*c* do not push the sheet end portion when the sheet is aligned.

In the first embodiment, the sheet abutting member 51 and the jogger 40*c* are retractable by at least 8 mm. However, the invention is not limited to the configuration of the first embodiment. The sheet abutting member 51 and the jogger 40*c* may be configured to be retractable by at least a length between the first-size sheet alignment position and the second-size sheet alignment position. In the first embodiment, the process is performed to the two sizes of the first-size sheet and the second-size sheet. However, the invention can be applied to the cases in which the sheets having various sizes are aligned as long as the sheet abutting member 51 and the jogger 40*c* do not damage the sheets.

In the case where the first sheet is further pushed by 8 mm compared with the A4-size sheet, the abutment force which applies to the sheet end portion with the spring force by the sheet abutting member 51 of the jogger 40*a* and the jogger 40*c* becomes larger than that of the original additional alignment amount of 3.5 mm. Therefore, the alignment roller 36 may not move the sheet in the subsequent alignment in the conveyance direction. Therefore, in the first embodiment, during the alignment operation of the first sheet, after the sheet is caused once to abut on the second alignment reference wall 41, the sheet is retracted to the position where the jogger is widened by 4.5 mm such that the additional alignment amount becomes 3.5 mm, and the alignment is performed in the conveyance direction.

Accordingly, the same condition as other sheets is established with respect to the alignment in the conveyance direction. In order to obtain the time necessary to perform the operation, the time interval between the sheets delivered from the image forming apparatus may be lengthened only for the time interval between first and second sheets.

Thus, according to the first embodiment, the staple of the stapler can be prevented from striking the air, and the misalignment, the generation of the jam, and the breakage of the stapler can be prevented without adding the mechanism for detecting the sheet alignment state to the sheet processing apparatus.

Second Embodiment

Figure 14:
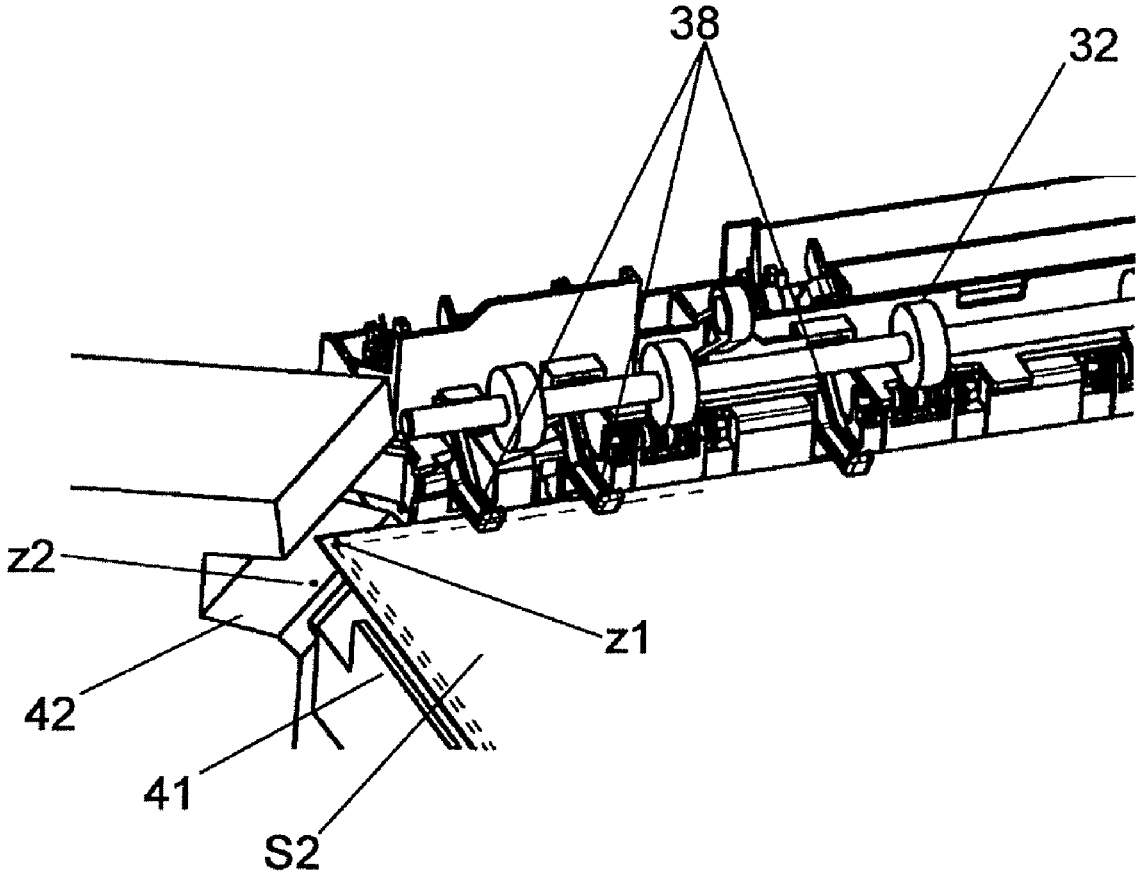
FIG. 14 is a perspective view showing a sheet processing apparatus according to a second embodiment of the invention.

A sheet processing apparatus and an image forming apparatus according to a second embodiment of the invention will be described below with reference to FIG. 14. FIG. 14 is a perspective view showing the sheet processing apparatus of the second embodiment. The same component as the first embodiment is designated by the same numeral, and the description is not repeated.

As shown in FIG. 14, in the sheet processing apparatus of the second embodiment, the alignment amount of 8 mm is added to perform the alignment operation only for the final sheet in the plural sheets S to be stapled.

In the case of the insufficient time interval between the sheets delivered from the image forming apparatus with respect to the alignment operation, as described in the first embodiment, a distance is widened between the fist and second sheets when the alignment operation is performed to the first sheet.

However, after the last sheet is aligned, the image forming apparatus is temporarily stopped for a time enough to perform the binding process with the stapler and the discharge operation of the stapled sheet bundle. In the second embodiment, the time can be used to perform the alignment operation to the last sheet, and the influence on the throughput can be suppressed to the minimum.

The performance of the alignment operation to the last sheet with the additional alignment amount is that movement of the second-size sheet alignment distance of the sheet abutting member 51 and jogger 40*c* acts on all the plural sheets S stacked on the intermediate stacking portion 34. That is, all the plural sheets S are moved to the position where the staple can be avoided from striking the air.

Third Embodiment

Figure 15:
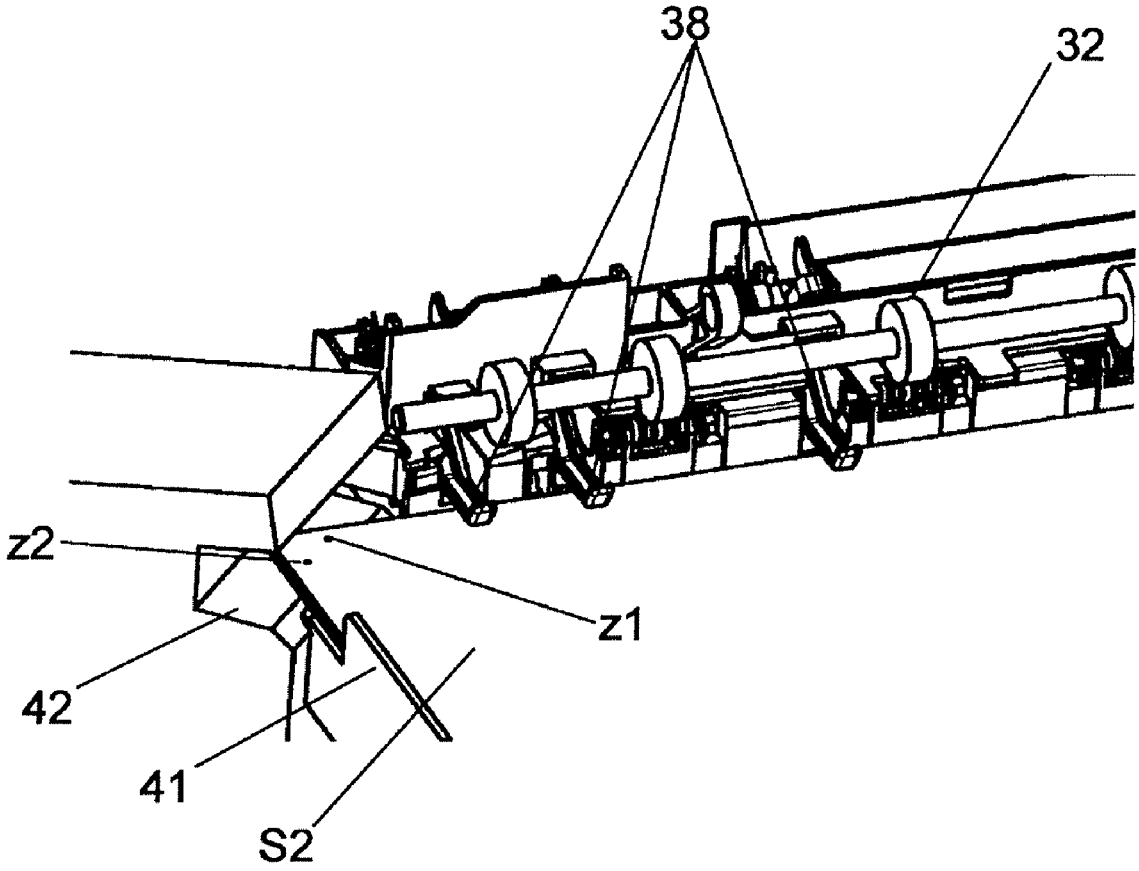
FIG. 15 is a perspective view showing a sheet processing apparatus according to a third embodiment of the invention.
Figure 16:
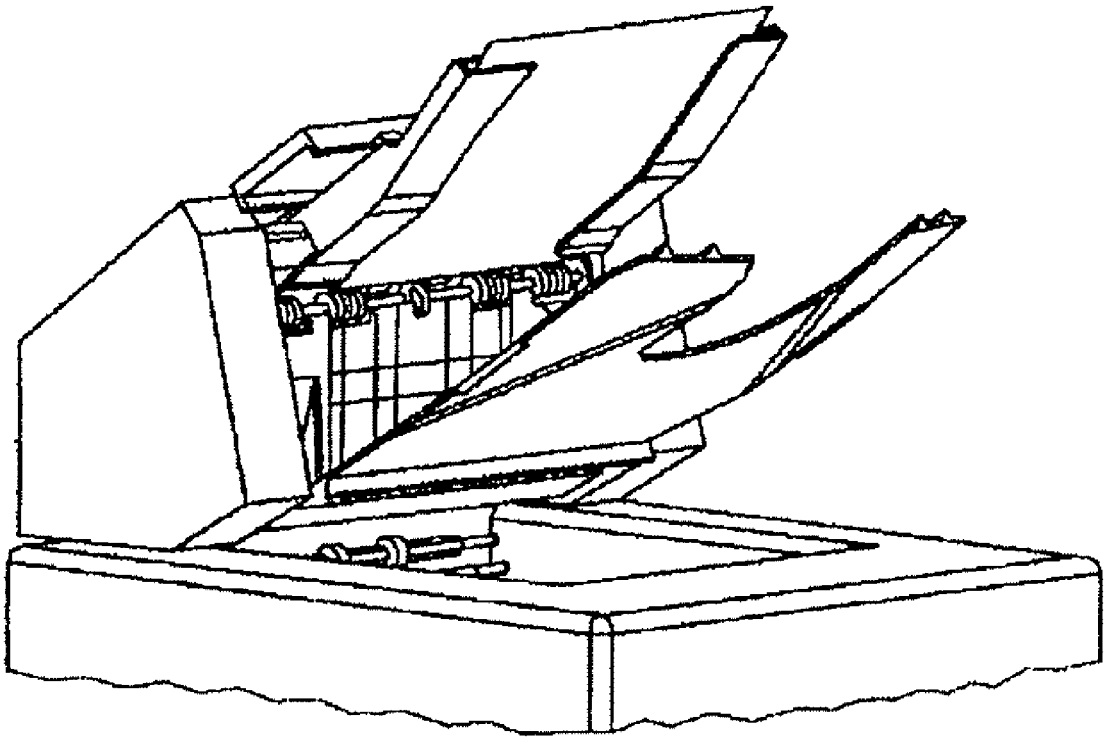
FIG. 16 is a perspective view of a conventional sheet processing apparatus.

A sheet processing apparatus and an image forming apparatus according to a third embodiment of the invention will be described below with reference to FIG. 15. FIG. 15 is a perspective view showing the sheet processing apparatus of the third embodiment. The same component as the first embodiment is designated by the same numeral, and the description is not repeated.

In the third embodiment, the sheet S is aligned such that the stapling process is securely performed, even if the letter-size sheet having the second length is conveyed while wrongly detected as the A4-size sheet having the first length. Specifically, in the case where the letter-size sheet is conveyed while wrongly detected as the A4-size sheet, the sheet end portion is located at the position of 158.9 mm away from the reference a after the letter-size sheet is aligned, and the sheet end portion is located by 14.1 mm away from the second alignment reference wall 41 which is of the position of 173 mm. Therefore, at least the additional alignment amount of 14.1 mm is added to the original additional alignment amount of 3.5 mm and, in the third embodiment, the additional alignment amount of 15 mm including a conveyance margin is added to the original additional alignment amount of 3.5 mm. That is, the sheet S is moved in the total additional alignment amount of 18.5 mm.

The sheets S are aligned as shown in FIG. 15 by performing the operation to all the plural sheets S to be stapled, and the sheet processing apparatus can securely perform the stapling operation even if the letter-size sheet is conveyed while wrongly detected as the A4-size sheet.

At this point, the sheet abutting member 51 of the jogger 40*a* and the jogger 40*c* are formed so as to be retractable by the additional alignment amount of 18.5 mm, and the sheets are aligned in the sheet conveyance direction after the joggers are separated from each other by 15 mm. Alternatively, the distance between the sheets may be widened by the amount necessary for the alignment operation.

When an aligning process is performed without a stapling process, the sheet processing apparatus can securely perform the aligning process by setting the alignment amount.

The invention is not limited to the above embodiments which perform an aligning process in a direction perpendicular to the sheet conveyance direction, the invention is effective in an aligning process, using the first alignment reference wall 37 and the alignment roller 36, in the sheet conveyance direction.

The invention is not limited to the above embodiments, but the alignment members (joggers 40*a* and 40*c*) may be configured to be moved by the second-size sheet alignment distance each time of the conveyance of the plural sheets to which the stapling process is performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-099057, filed Mar. 31, 2006 and No. 2007-068708, filed Mar. 16, 2007 which are hereby incorporated by reference herein in their entirety.

What is claimed is:

1. A sheet processing apparatus which processes a sheet after aligning the sheet, the sheet processing apparatus comprising:

a conveyance portion which conveys the sheet;

a stacking portion on which the sheet conveyed by the conveyance portion is stacked;

an alignment reference member on which end portions, in a width direction perpendicular to a sheet conveyance direction of the conveyance portion, of the sheets conveyed to the stacking portion are abutted to align the sheets;

an alignment member which is (1) moved from a first standby position toward the alignment reference member to align a first-size sheet having a first length in the width direction, and (2) moved from a second standby position, which is closer to the alignment reference member than the first standby position, toward the alignment reference member to align a second-size sheet having a second length in the width direction smaller than the first length in the width direction;

a stapler which performs a stapling process of stapling the sheets with a staple having two staple legs; and a controller which controls movement of the alignment member, wherein the controller controls the movement of the alignment member based on information that the sheets to be aligned are the first-size sheets so that the alignment member is moved to align the first-size sheets from the first standby position toward the alignment reference member, by a distance which, even if the sheet conveyed to the stacking portion is the second-size sheet, allows the stapler to staple the sheets moved by the alignment member with at least one of the two staple legs.

2. The sheet processing apparatus according to claim 1, wherein the alignment member is moved by the distance at least one time while the plurality of sheets are conveyed to the stacking portion.

3. The sheet processing apparatus according to claim 1, wherein the alignment member is moved by the distance when the first sheet or the last sheet of the plurality of sheets is conveyed.

4. The sheet processing apparatus according to claim 1, wherein the alignment member is moved by the distance each time the plurality of sheets are conveyed.

5. The sheet processing apparatus according to claim 1, wherein the alignment member includes an abutment portion which elastically abuts on an end portion of the

6. An image forming apparatus comprising:

an image forming portion which forms an image on a sheet; and the sheet processing apparatus which processes the sheet on which the image is formed by the image forming portion, the sheet processing apparatus including:

a conveyance portion which conveys the sheet;

a stacking portion on which the sheet conveyed by the conveyance portion is stacked;

an alignment reference member on which end portions, in a width direction perpendicular to a sheet conveyance direction of the conveyance portion, of the sheets conveyed to the stacking portion are abutted to align the sheets;

an alignment member which is (i) moved from a first standby position toward the alignment reference member to align a first-size sheet having a first length in the width direction, and (2) moved from a second standby position, which is closer to the alignment reference member than the first standby position, toward the alignment reference member to align a second-size sheet having a second length in the width direction smaller than the first length in the width direction;

a stapler which performs a stapling process of stapling the sheets with a staple having two staple legs; and a controller which controls movement of the alignment member, wherein the controller controls the movement of the alignment member based on information that the sheets to be aligned are the first-size sheets so that the alignment member is moved to align the first-size sheets from the first standby position toward the alignment reference member by a distance which, even if the sheet conveyed to the stacking portion is the second-size sheet, allows the stapler to staple the sheets moved by the alignment member with at least one of the two staple legs.

7. The image forming apparatus according to claim 6, wherein the alignment member is moved by the moving distance at least one time while the plurality of sheets are conveyed to the stacking portion.

8. The image forming apparatus according to claim 6, wherein the alignment member is moved by the moving distance when the first sheet or the last sheet of the plurality of sheets is conveyed.

9. The image forming apparatus according to claim 6, wherein the alignment member is moved by the moving distance each time the plurality of sheets are conveyed.

10. The image forming apparatus according to claim 6, wherein the alignment member includes an abutment portion which elastically abuts on an end portion of the sheet in the moving direction of the alignment member.

* * * * *